US011550265B2

(12) United States Patent
Fleury et al.

(10) Patent No.: US 11,550,265 B2
(45) Date of Patent: Jan. 10, 2023

(54) DRIVE DEVICE FOR HOROLOGY CALENDAR SYSTEM

(71) Applicant: ROLEX SA, Geneva (CH)

(72) Inventors: Christian Fleury, Geneva (CH); Denis Rudaz, Segny (FR)

(73) Assignee: ROLEX SA, Geneva (CH)

( * ) Notice: Subject to any disclaimer, the term of this patent is extended or adjusted under 35 U.S.C. 154(b) by 1031 days.

(21) Appl. No.: 16/162,571

(22) Filed: Oct. 17, 2018

(65) Prior Publication Data

US 2019/0129362 A1 May 2, 2019

(30) Foreign Application Priority Data

Nov. 2, 2017 (EP) ..... 17199763

(51) Int. Cl.
*G04B 19/253* (2006.01)
*G04B 19/25* (2006.01)
*G04B 11/00* (2006.01)

(52) U.S. Cl.
CPC ... *G04B 19/2538* (2013.01); *G04B 19/25373* (2013.01); *G04B 11/006* (2013.01); *G04B 19/25* (2013.01)

(58) Field of Classification Search
CPC ..... G04B 19/2538; G04B 19/25373; G04B 19/25; G04B 11/006
See application file for complete search history.

(56) References Cited

U.S. PATENT DOCUMENTS

| | | | | |
|---|---|---|---|---|
| 7,218,576 | B1 * | 5/2007 | Bron | G04B 19/2538 368/37 |
| 8,760,975 | B2 | 6/2014 | Rudaz | |
| 9,292,001 | B2 * | 3/2016 | Fleury | G04B 11/008 |
| 2006/0034157 | A1 | 2/2006 | Charpier | |
| 2009/0016169 | A1 | 1/2009 | Villar et al. | |
| 2012/0057434 | A1 | 3/2012 | Rudaz | |

(Continued)

FOREIGN PATENT DOCUMENTS

| | | | |
|---|---|---|---|
| CH | 710 109 | A2 | 3/2016 |
| CH | 711 851 | A1 | 6/2017 |
| EP | 1 416 340 | A1 | 5/2004 |

(Continued)

OTHER PUBLICATIONS

European Search Repod and Written Opinion dated Apr. 26, 2018 issued in counterpad application No. EP17199763; w/ English machine translation (11 pages).

*Primary Examiner* — Edwin A. Leon
*Assistant Examiner* — Jason M Collins
(74) *Attorney, Agent, or Firm* — WHDA, LLP

(57) ABSTRACT

Drive device (100), notably for a horology calendar system (200), the drive device including a drive mobile (10) for driving an element (4) that is to be driven, notably a calendar element, the drive mobile being intended to be mounted so that it can rotate about an axis (A1) and including (a) a support (11); (b) a first flank (f11) for driving the element that is to be driven; and (c) a second flank (f12') arranged in such a way as to receive an action to retract the drive mobile, notably extending orthoradially or substantially orthoradially with respect to the axis (A1); the mobile comprising a slide link (111, 121; 11, 120; 110, 120') connecting the second flank to the support.

20 Claims, 9 Drawing Sheets

(56) References Cited

U.S. PATENT DOCUMENTS

2017/0153602 A1 6/2017 Rudaz

FOREIGN PATENT DOCUMENTS

| | | | |
|---|---|---|---|
| EP | 2 015 146 | A1 | 1/2009 |
| EP | 2 428 855 | A1 | 3/2012 |
| EP | 3 173 878 | A1 | 5/2017 |
| FR | 1 467 726 | A | 1/1967 |

* cited by examiner

DRIVE DEVICE FOR HOROLOGY CALENDAR SYSTEM

This application claims priority of European patent application No. N° EP17199763.8 filed Nov. 2, 2017, which is hereby incorporated by reference herein in its entirety.

The invention relates to a drive device, notably for a horology calendar system. The invention also relates to a horology calendar system comprising such a device. The invention further relates to a timepiece comprising such a system or such a device.

In particular, the drive device allows the driving of a device for displaying determined time periods. The invention also relates to a drive mobile for an instantaneous-jump calendar system.

Drive mechanisms are known from the prior art. Drive mechanisms are generally provided with a drive member designed to drive a toothset of a display member of a calendar indicator under the effect of instantaneous restitution of energy previously accumulated by an appropriate device.

The drive member may take the form of a rigid finger, like the one disclosed, for example, in FIG. 11 of patent application EP2015146. However, there is a risk that such a finger will oppose an ancillary correction mechanism of the calendar if said finger is placed in the toothset of the calendar disk. There is therefore a risk of the calendar being broken during adjustment of the timepiece.

The drive member may also take the form of an elastic finger like the one disclosed, for example, in patent application EP3173878. Such a finger is shaped in such a way as to, on the one hand, instantaneously drive a calendar disk and, on the other hand, stop the calendar disk once the date jump has been made, the purpose of this being to obviate any risk of a double date jump. Thus, this finger also acts as a stop coming up against a tooth of the toothset of the calendar disk. Notably in the case of an annual or perpetual calendar, the energy accumulated by the calendar drive mobile may be such that there is a risk of the elastic driving finger being retracted under the effect of the calendar disk once the date jump has been made.

Document FR1467726 discloses a drive mobile provided with an elastic drive member. The latter takes the form of a spring built into a calendar wheel, and one end of which takes the form of a drive finger. The spring is gradually tensioned under the effect of a tooth on a calendar disk until the finger comes into abutment against a stop surface, which causes the date jump. Such a mobile does not allow a date jump that is perfectly instantaneous because the spring is tensioned gradually, and this means that there is a slight angular offsetting of the calendar disk before the date jump. Furthermore, there is a risk that the finger will be retracted under the effect of the calendar disk once the date jump has been made. There may therefore remain a risk of a double date jump. In this construction, contact between the finger that is formed as an integral part of the spring and the stop surface is point contact, with a view to offering an alternative calendar drive mobile to the cam drive mobile.

Document CH711851 relates to a drive mobile similar to that of patent FR1467726. Therein we find a drive finger formed as an integral part of a spring built into a wheel. One flank of the finger is capable of coming into point contact against a stop so as to trigger the date jump. That document relates more particularly to optimizing the geometry of the finger so as to allow the calendar to be adjusted quickly when the finger is positioned within the toothset of a calendar star.

Document EP2428855 discloses a cam drive mobile provided with a pivoting drive member made up of a pivot, of a return spring and of a drive finger on three distinct levels. While such a mobile performs the functions of driving and stopping the calendar disk while at the same time allowing rapid adjustment of the calendar at all times, both in the clockwise and counterclockwise directions, it does require a significant amount of space to be made available to allocate the various functions of the drive member.

The object of the invention is to provide a drive device for a calendar system that makes it possible to overcome the aforementioned disadvantages and improve the devices known from the prior art. In particular, the invention proposes a compact drive device for a calendar system and/or a device the reliability and robustness of which are improved relative to the systems known from the prior art.

A drive device according to the invention is defined by point 1 below.

1. A drive device, notably for a horology calendar system, the drive device comprising a drive mobile for driving an element that is to be driven, notably a calendar element, the drive mobile being intended to be mounted so that it can rotate about an axis and comprising:

a support;

a first flank for driving the element that is to be driven; and a second flank arranged in such a way as to receive an action to retract the drive mobile, notably extending orthoradially or substantially orthoradially with respect to the axis;

the mobile comprising a slide link connecting the second flank to the support.

Various embodiments of the device are defined by points 2 to 12 below.

2. The device as defined in the preceding point, wherein the second flank is attached to the first flank.

3. The device as defined in either of the preceding points, wherein the mobile comprises an elastic return element returning the second flank toward a rest position.

4. The device as defined in the preceding point, wherein the elastic return element comprises a spring, notably a spring in the form of an open ring and/or a spring having the second flank at a first end and having an attachment to the support at a second end.

5. The device as defined in one of the preceding points, wherein the slide link comprises a pin produced on an element bearing the second flank and a slot produced on the support or wherein the slide link comprises a slot produced on an element bearing the second flank and a pin produced on the support.

6. The device as defined in one of the preceding points, wherein the slide link comprises a first face produced on an element bearing the second flank and a second face produced on the support.

7. The device as defined in one of the preceding points, wherein the first flank exhibits a first surface that is planar or substantially planar or curved and/or wherein the second flank exhibits a second surface that is planar or substantially planar or curved.

8. The device as defined in one of the preceding points, wherein the first flank extends radially or substantially radially relative to the axis.

9. The device as defined in one of the preceding points, wherein the second flank is a retraction flank of the mobile.

10. The device as defined in one of the preceding points, wherein the mobile comprises a third flank for braking the element that is to be driven, notably a third flank extending radially or substantially radially relative to the axis.

11. The device as defined in one of the preceding points, wherein the first flank is fixed or substantially fixed angularly about the axis with respect to the support and/or wherein the third flank is fixed or substantially fixed angularly about the axis with respect to the support.

12. The device as defined in one of the preceding points, wherein the support is secured to a calendar cam.

A calendar system according to the invention is defined as a horology calendar system comprising a drive device as defined in one of the preceding points and an element that is to be driven, notably a calendar indicator mobile, particularly a disk indicating the days of the month.

A horology movement according to the invention is defined as a horology movement comprising a device as defined in one of points 1 to 12 and/or a system as defined in the preceding point.

A timepiece according to the invention is defined as a timepiece, notably a wristwatch, comprising a device as defined in one of points 1 to 12 and/or a system as defined in point 13 and/or a movement as defined in the preceding point.

The attached figures depict, by way of example, two embodiments of a timepiece according to the invention.

Figure 1:
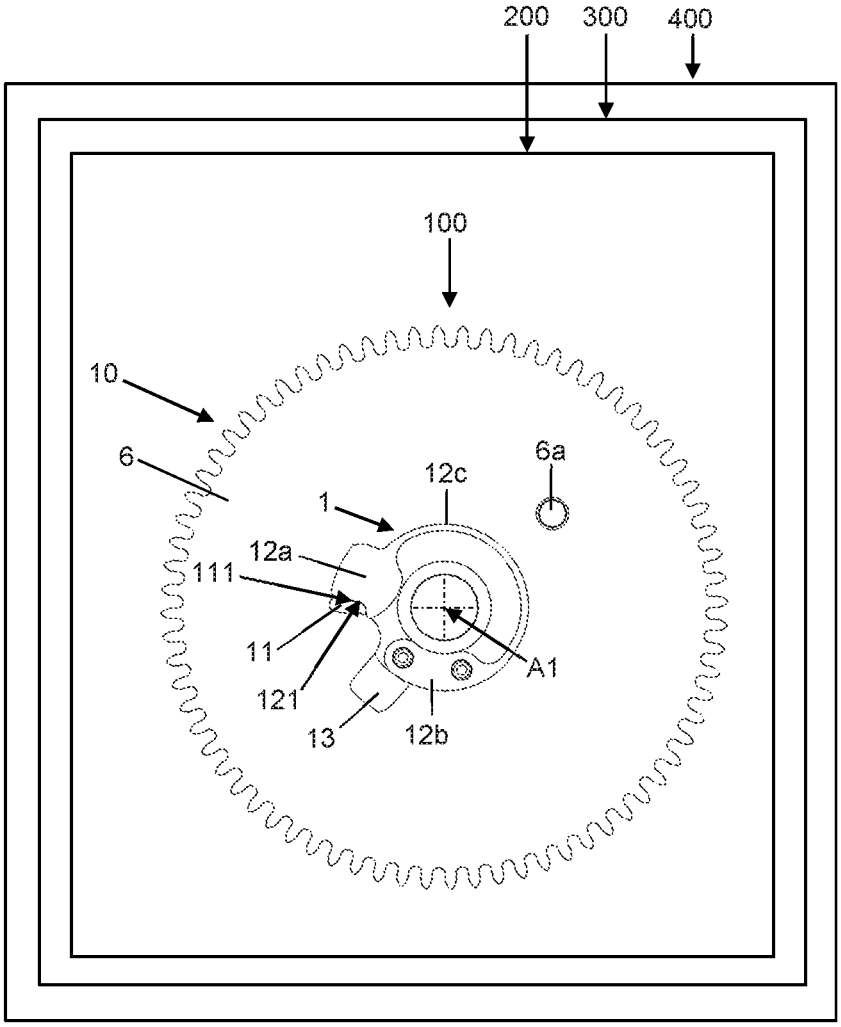
FIGS. 1 and 2 are schematic views of a first embodiment of a timepiece.
Figure 2:
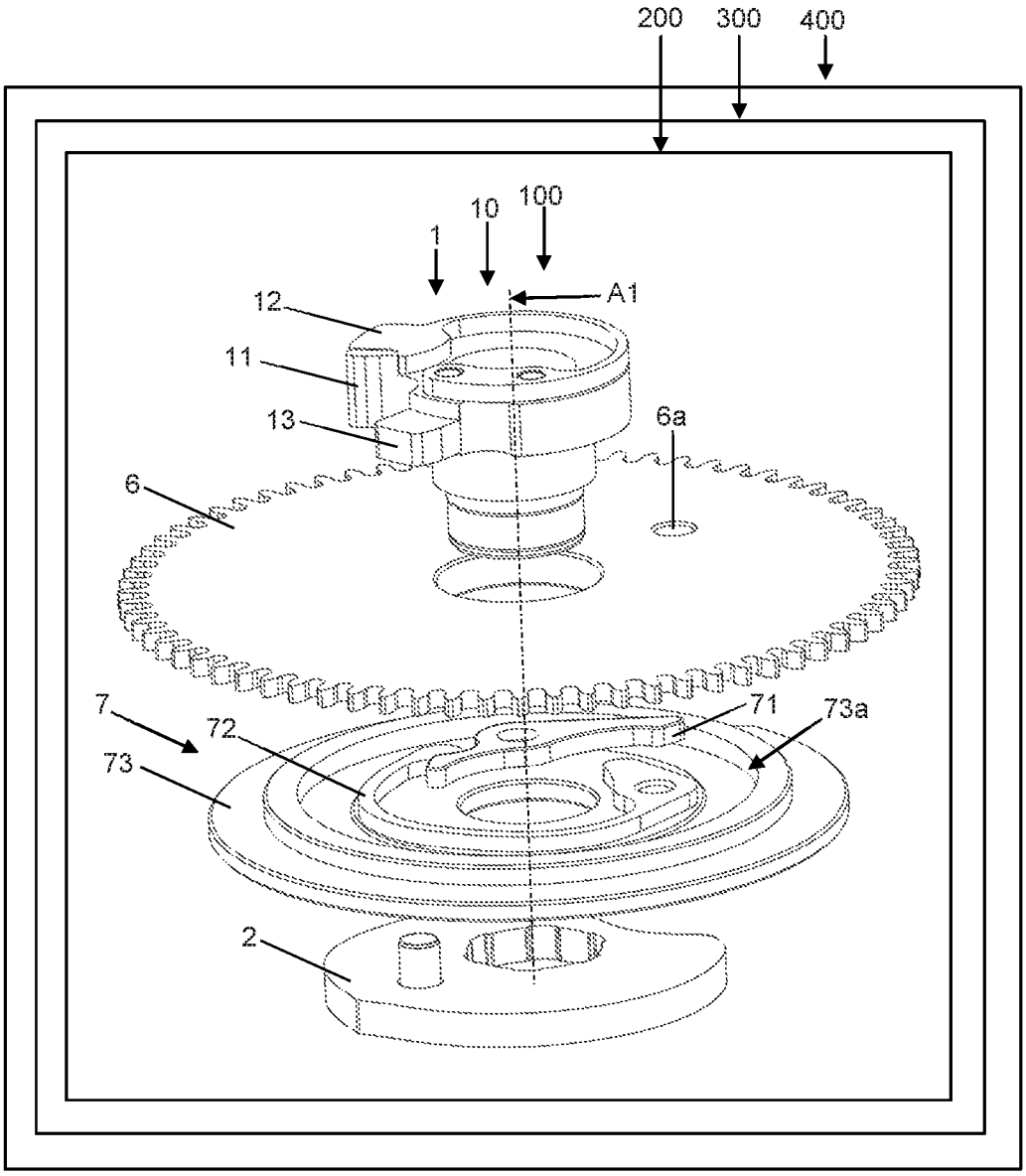
Figure 3:
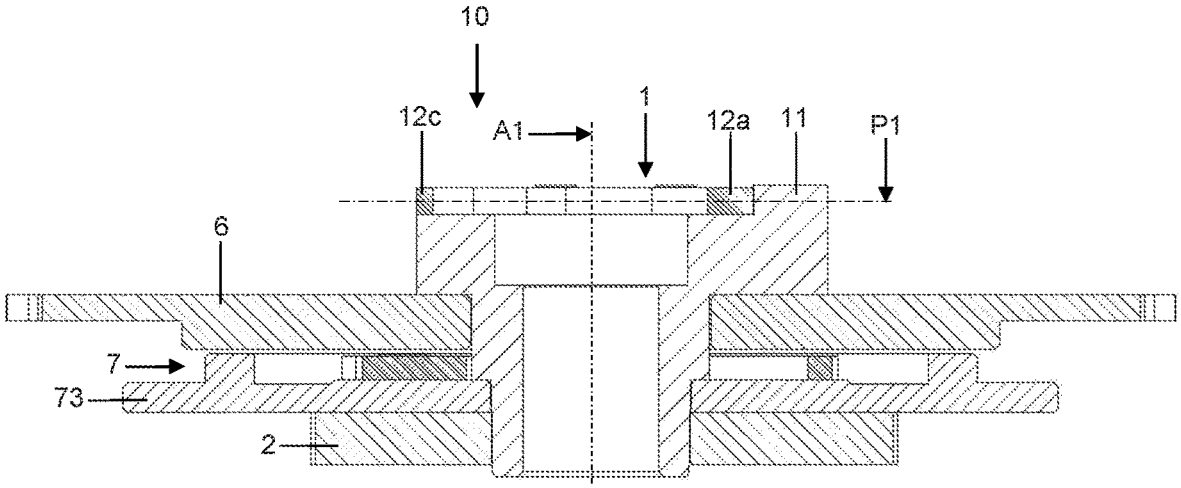
FIG. 3 is a view in section of a first embodiment of a drive device.
Figure 4:
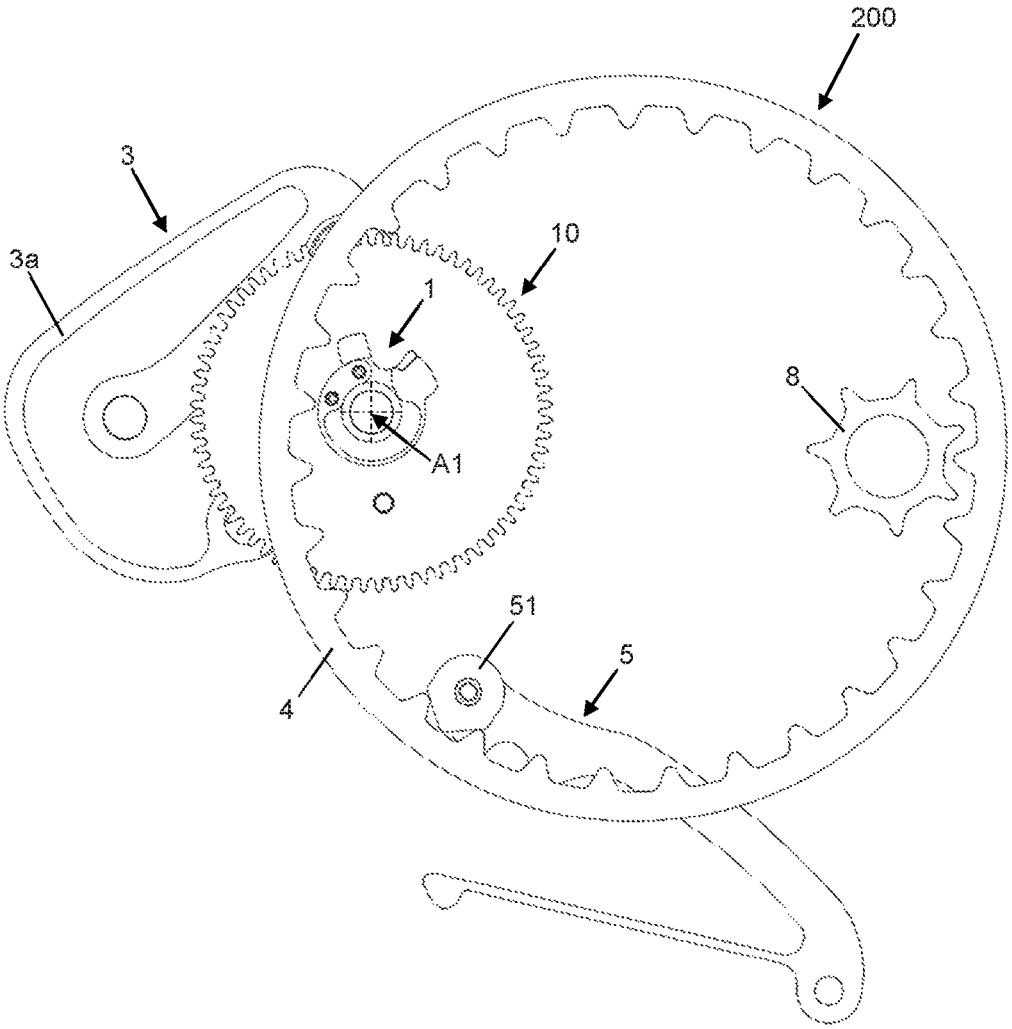
FIGS. 4 to 9 are views illustrating the operation of the first embodiment of the drive device.
Figure 5:
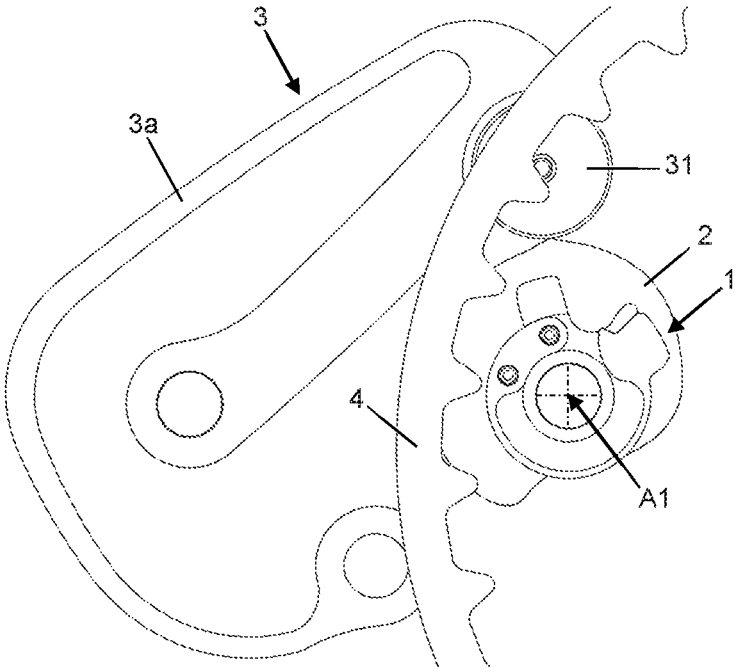

A first embodiment of a timepiece 400 is described hereinafter with reference to FIGS. 1 to 9. The timepiece is, for example, a watch, particularly a wristwatch. The timepiece comprises a horology movement 300. The horology movement may be a mechanical movement or an electronic movement. The movement comprises a horology calendar system 200. The calendar system makes it possible to display at least one piece of calendar information such as notably information about the day and/or information about the day of the month and/or information about the month and/or information about the year and/or information about the bissextile year and/or information about the phase of the moon.

To this end, the calendar system comprises an element 4 that is to be driven, such as a disk, notably a calendar disk, bearing the information that is to be displayed out of a plurality of information types.

The calendar system comprises a drive device 100.

The drive device comprises a drive mobile 10 for driving the element 4 that is to be driven, notably the calendar disk 4. The drive mobile is intended to be mounted so that it can rotate about an axis A1. The mobile comprises:

- a support 11;
- a first flank f11 for driving the element that is to be driven; and
- a second flank f12' arranged in such a way as to receive an action to retract the drive mobile, notably a second retraction flank f12' extending orthoradially or substantially orthoradially with respect to the axis A1;

the mobile comprising a slide link 111, 121 connecting the second flank to the support.

Advantageously, the slide link is oriented radially or substantially radially relative to the axis A1.

The element that is to be driven does not form part of the drive device.

The first flank may be made up of a first surface that is planar or substantially planar or curved. The second flank may be made up of a second surface that is planar or substantially planar or curved.

The first flank may extend radially or substantially radially relative to the axis A1. Advantageously, the first flank also extends parallel or substantially parallel to the axis A1. For preference, the first flank is fixed or substantially fixed angularly about the axis A1 with respect to the support.

The second flank is arranged in such a way as to receive a mobile-retraction action, notably so as to receive a mechanical action to retract the mobile, the action being produced by the element that is to be driven when the mobile 10 is in a position that interferes with the element that is to be driven.

For preference, the second flank extends orthoradially or substantially orthoradially relative to the axis A1. The second flank may extend so that it makes an angle less than 30° with the direction orthoradial to the axis A1. Advantageously, the second flank also extends parallel or substantially parallel to the axis A1.

Thus, the device comprises a rigid first member 11, notably the support, including the first drive flank f11 and an elastic second member 12 including the second flank f12', which are designed to collaborate with one another. For preference, the second member 12 also comprises a third stop flank f12 designed to stop the element that is to be driven. Advantageously, such an embodiment allows reliable driving of the calendar disk by virtue of the driving first member, notably by virtue of the first flank f11 of the driving first member, and correction of the calendar at any time by virtue of the elastic second member, notably by virtue of the second flank f12' of the elastic second member 12. Furthermore, such an embodiment allows the calendar disk to be stopped reliably by virtue of the elastic second member 12, notably by virtue of the third, stop, flank f12 of the elastic member 12. Advantageously, this structure of drive device offers the advantages of being compact and simple to implement.

In this first embodiment, the rigid first member 11 and the elastic second member 12 of the drive mobile 10 are positioned in the one same plane or on the one same level P1.

These first and second members 11 and 12 both form part of a drive member 1 pivoted about an axis A1 relative to a guide means of the frame of the movement not depicted in the figures. The drive member forms part of the drive device.

The drive member 1 here takes the form of a tubular boss at least a portion of which is designed to accept the first and second members 11, 12. The rigid first member 11 may be formed as one piece with the member 1. This in this instance takes the form of a protrusion of material projecting from the member 1 along the axis A1, namely a projection extending longitudinally to the axis A1. This projection also notably extends in a direction that is radial or substantially radial relative to the axis A1.

The elastic second member 12 for its part is attached to the member 1. The elastic second member 12 is an elastic return element, such as a spring, a first end of which has a head 12*a* and a second end of which has a foot 12*b* built into or fixed rigidly to the member 1, notably using rivets. Thus, the first end exhibits the second flank. The second end itself exhibits an attachment to the support. The head 12*a* and the foot 12*b* are connected by an elastic part forming a curved spring 12*c*. The head 12*a* is preferably in contact with the rigid member 11. For preference, the members 11 and 12 are shaped in such a way that the head 12*a* has just one single degree of freedom of movement (give or take tolerances) in a direction that is radial or substantially radial relative to the axis A1. The curved spring 12*c* constitutes an elastic return element 12*c* returning the second member 12 and the second flank f12' toward a rest position, as illustrated in FIGS. 1, 2 and 5 to 9. The spring 12*c* for example has the shape of an open ring.

For example, the slide link connecting the second flank to the support comprises a first face 121 produced on the element bearing the second flank, notably the head 12*a*, and a second face 111 produced on the support 11. The faces 111 and 121 are preferably planar and/or the faces 111 and 121 preferably extend radially or substantially radially relative to the axis A1. Advantageously, the faces 111 and 121 also extend parallel or substantially parallel to the axis A1. For preference, an elastic return element, notably the spring 12*c*, is shaped and/or arranged in such a way as to return the faces 111 and 121 against one another.

In this first embodiment, the second flank can be moved relative to the first flank according to the slide link, against the action of the elastic return element.

The drive member 1 is secured to a cam 2, notably a calendar cam, collaborating with an energy accumulator 3, so that this member can instantaneously drive, by at least one angular step, the toothset of the disk 4 that displays the days of the month, which toothset is angularly indexed via a beak 51 of a jumper 5. For preference, the support 11 is secured to the calendar cam 2.

The energy accumulator here consists of a lever 3 provided with a roller 31 pressed against the flank of the cam 2 under the effect of a lever portion 3*a* acting as a spring, and makes it possible, during the change in date, to overcome the torque produced by the jumper 5.

The mobile 10 moreover comprises a wheel 6, pivoting freely about the axis A1 about the member 1, and which is connected to a basic movement, notably to an hours wheel not depicted in the figures, so that the date jump can take place once a day at midnight. The connection between the drive member 1 and the wheel 6 is via a one-way connection device 7 the principle of operation of which is described in document EP2428855.

This device 7 comprises a pawl member 71 and a spring 72 both of which are pivoted on a plate 73 driven onto the member 1. The spring 72, bearing against one end of the member 71, tends to keep the opposite end of this member 71 against a wall 73*a* of the plate 73. This member 71 is driven by the wheel 6 in a one-way drive collaborating by obstacle with a stud 6*a* projecting from the disk of the wheel 6.

This device 7 comprises the 24-hours wheel 6 which is in mesh with the hours wheel or cannon wheel (not depicted) of the geartrain of the timepiece. The gear ratio between the 24-hours wheel 6 and the hours wheel is such that the 24-hours wheel 6 makes one revolution in 24 hours. That wheel pivots freely about a first segment of the tubular boss 1 mounted with the ability to pivot on a pivot secured to a frame of the timepiece.

A circular recess comprising the wall 73*a* is formed in the plate 73. The pawl member 71 is pivot mounted using a pivot in the recess. The spring 72, bearing against one end of the pawl member 71, tends to keep the opposite end of this pawl member 71 against the lateral wall of the circular recess. This pawl member 71 acts as a one-way drive member between the 24-hours wheel 6 and the plate 73 which is secured to the member 1.

The tubular boss 1 also comprises a second segment smaller in diameter than the first segment on which the 24-hours wheel 6 pivots and which extends below this 24-hours wheel 6. The instantaneous jump cam 2 is driven onto the second segment of the tubular boss 1 and can bear against a bearing surface formed between the first and second segments via the plate 73 itself driven onto said second segment of the tubular boss 1.

The instantaneous jump cam 2 is engaged with the roller 31 borne by the lever 3 which is pressed against the cam 2 by the spring 3*a*. This cam 2 comprises at least one tensioning surface, one instantaneous jump surface and one stop surface, notably a concave stop surface. The intersection between the two tensioning and instantaneous jump surfaces determines the exact moment at which the lever 3, urged by the spring 3*a*, will cause the roller 31 to pass sharply over this intersection to the stop surface.

FIGS. 1 to 4 illustrate the aforementioned features in detail. For the sake of clarity, FIGS. 5 to 9, which detail the sequencing of an instantaneous date jump, and of the phases for quickly adjusting the date, do not depict either the wheel 6 or the one-way connection device 7.

Throughout the day, the wheel 6 drives a cam 2 via the device 7 and accumulates the energy needed for the instantaneous jump of the member 1, namely the energy needed for rotation over a predetermined angular range of the member 1, tensioning the elastic portion 3*a* of a spring via a roller 31 and the cam 2 profile. Just before the change in date (illustrated in FIGS. 4 and 5), the roller 31 is positioned substantially at the top of the cam 2 profile. The change in date (illustrated in FIG. 6) occurs in a fraction of a second when the spring portion 3*a* releases the accumulated energy by imparting a sharp rotational movement to the cam 2 and to the member 1 via the lever 3 and its roller 31. This relative movement between the elements 1, 2 and the wheel 6 is made possible by the degree of freedom offered by the one-way connection device 7.

Figure 6:
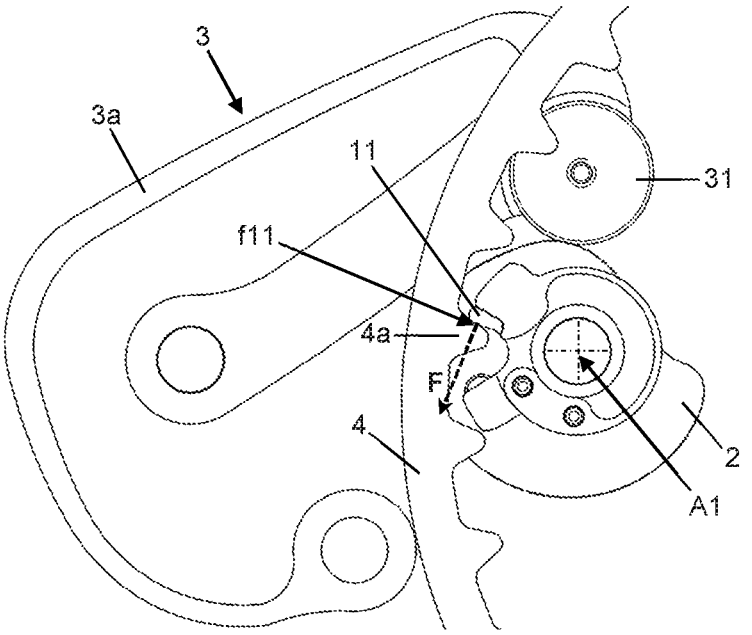

For preference, the rigid first member 11 advantageously constitutes a calendar drive finger and comprises a flank f11 which is designed to come into direct contact with a tooth 4*a* of the disk 4, as depicted in FIG. 6. Thus, because of the rigidity of the first member, the drive member 1 does not experience any unwanted deformation during the driving of the disk and thus transmits to the disk 4 a force F that is orthoradial or substantially orthoradial relative to the axis A1, and the orientation of which is constant or substantially constant with reference to the tooth 4*a*. During this sequence of operation, the elastic member 12 has no effect on the disk.

Figure 7:
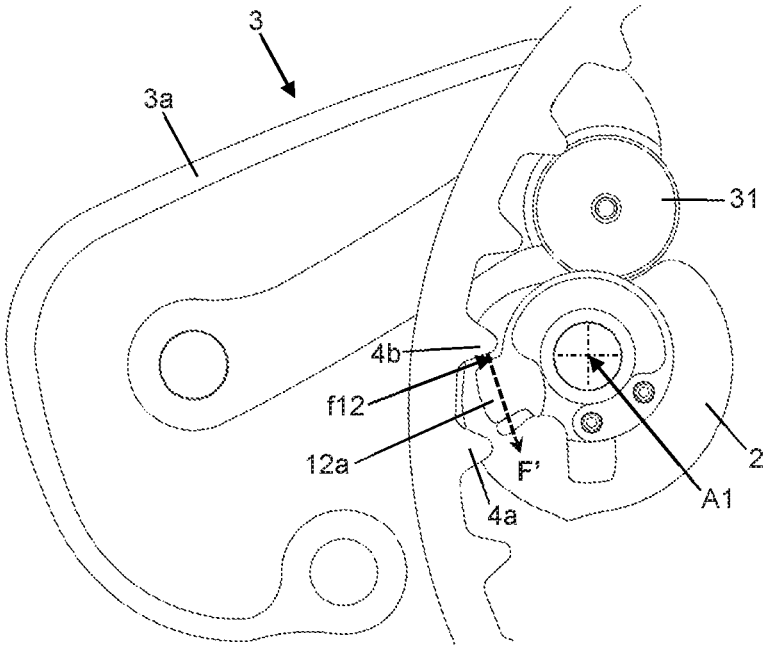

Once the date jump has occurred (as illustrated in FIG. 7), the disk 4 is braked by the member 1 via a tooth 4*b* sitting alongside the tooth 4*a*, which butts against the third stop flank f12 of the head 12*a* of the second elastic member 12, which is itself in abutment or capable of coming into abutment against the rigid first member 11, under the effect of a reaction force F' that is orthoradial or substantially orthoradial relative to the axis A1. During this sequence of operation, the spring 12*c* of the elastic second member 12 has no effect. Thus, the member 1 does not experience any unwanted deformation during the braking of the disk when the elements 11 and 12*a* are positioned within the toothset of the disk 4, between two teeth 4*a*, 4*b*.

Thus, the third flank f12 is a braking flank or stopping flank braking or stopping the element 4 that is to be driven. For preference, this third flank extends radially or substantially radially relative to the axis A1. Advantageously, the third flank also extends parallel or substantially parallel to the axis A1. The third flank is preferably fixed or substantially fixed angularly about the axis A1 with respect to the support.

In the configuration of FIG. 7, the first member 11 and the second member 12, notably the head 12*a*, are held in position under the effect of a force that is predefined and established by the spring portion 3*a* of the lever 3, which holds the roller 31 in a dip defined by the cam 2 profile.

Before the date jump (illustrated in FIG. 5), the members 11 and 12*a* are out of reach of the toothset of the disk 4. It is therefore possible to make a rapid correction in date, whether this be in the clockwise or counterclockwise direction, by actuation of the toothset of the disk 4 using, for example, a correction star 8 that forms part of an ancillary correction mechanism that can be activated on demand.

Figure 8:
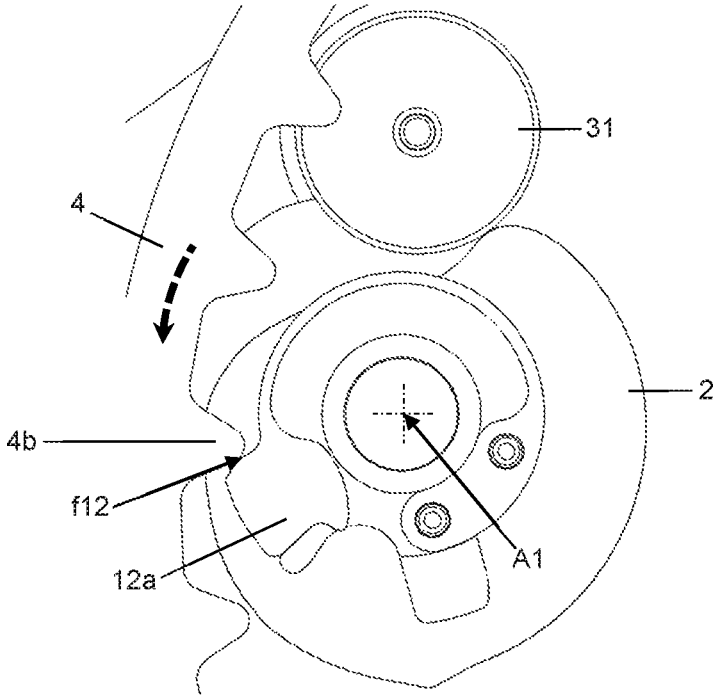

After the date jump, the members 11 and 12*a* are held in the toothset under the effect of a force that is predefined and established by the spring portion 3*a* of the lever 3, which holds the roller 31 in a dip defined by the profile of the cam 2. A rapid correction of the date in the clockwise direction as illustrated in FIG. 8 is nevertheless possible thanks to the one-way connection device 7 which allows the elements 1 and 2 to be uncoupled from the wheel 6.

Figure 9:
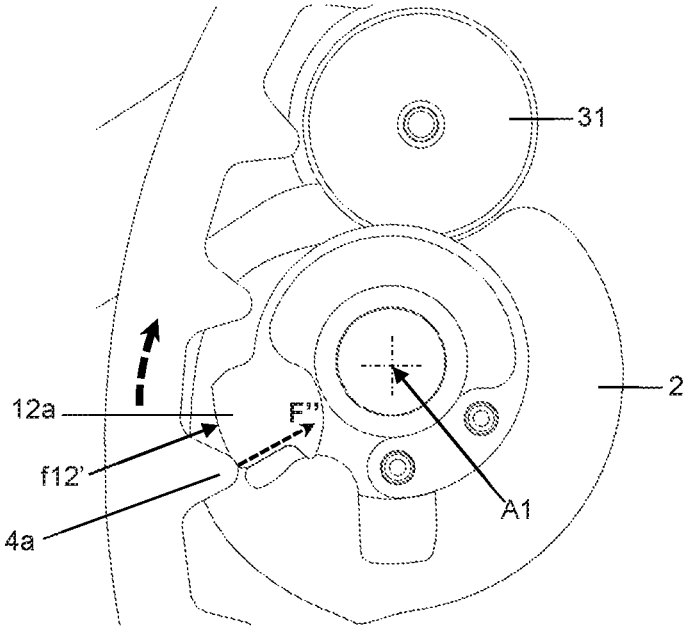

The first member 11 here has the particular feature of being shaped and/or arranged in such a way as to be out of reach of the toothset of the disk 4 once the date jump has occurred, as depicted in FIG. 9. Thus a rapid correction of the date in the counterclockwise direction as illustrated in FIG. 9 is entirely possible by virtue of the retraction of the head 12*a* under the effect of the tooth 4*a* pushing back the flank f12', elastically deforming the spring 12*c*. The force of action F" of the tooth 4*a* on the flank f12' of the head 12*a* in this instance is radial or substantially radial relative to the axis A1. The head 12*a* and the flank f12' that the head constitutes are distant from the rest position illustrated in FIGS. 1, 2 and 5 to 9. In this configuration, the head 12*a* here has the particular feature of being shaped and/or arranged in such a way that only its flank f12' is within reach of the tooth 4*a*. Once the correction has been made, the curved spring 12*c* elastically returns the second member 12 and the second flank f12' toward a rest position as illustrated in FIGS. 1, 2 and 5 to 9.

Thus, the second flank is preferably a retraction flank of the mobile, particularly for retracting the head 12*a* of the second member.

In the first embodiment, the first flank is fixed regarding to the support.

A second embodiment is described hereinafter with reference to FIGS. 10 to 12. This second embodiment differs from the first embodiment in that the second flank is secured to the first flank, namely that the first and second flanks are fixed relative to one another, and/or differs from the first embodiment through the way in which the slide link is embodied.

Figure 10:
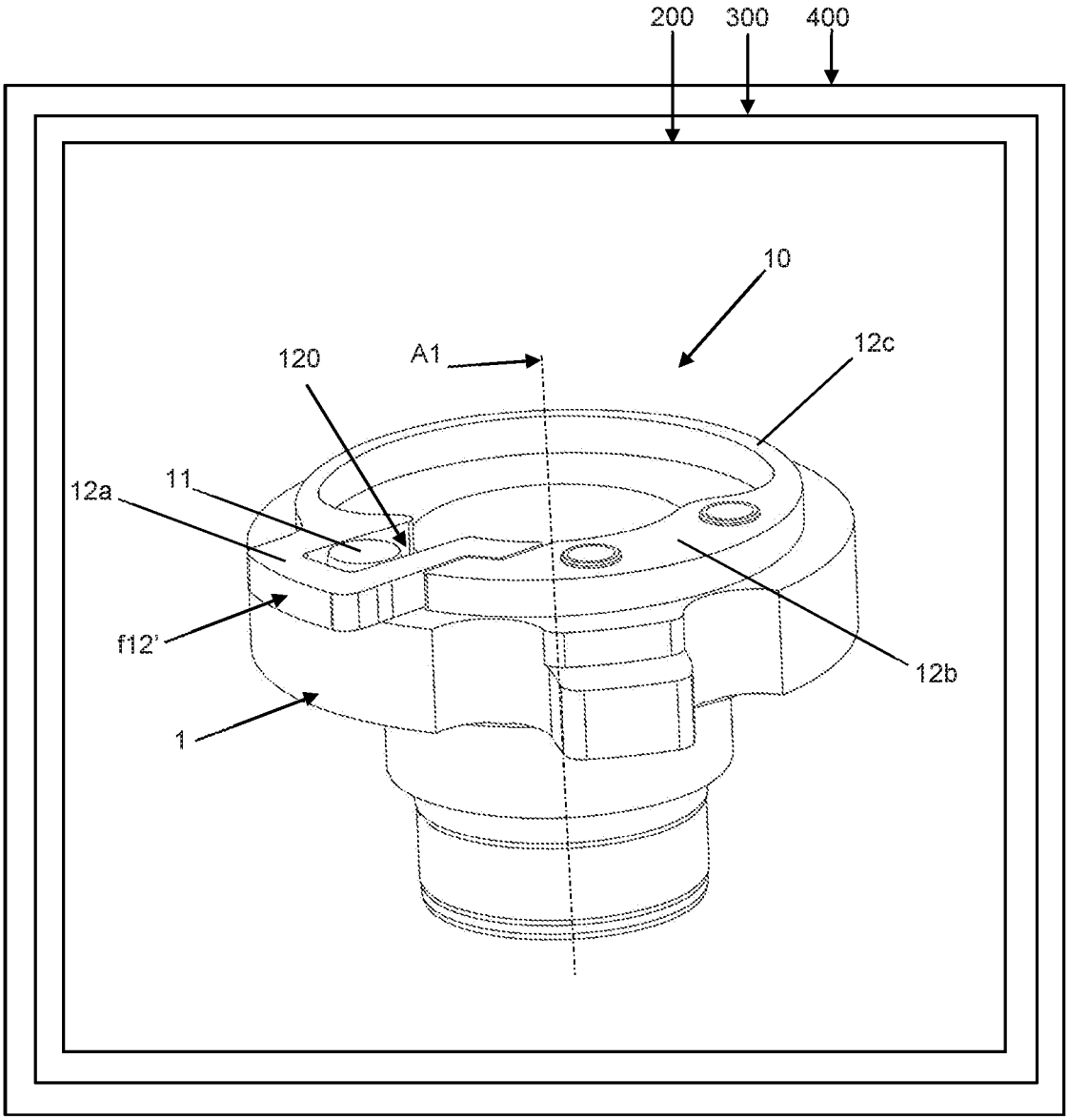
FIG. 10 is a schematic view of a first alternative form of a second embodiment of a timepiece.

In a first alternative form of the second embodiment, depicted in FIG. 10, the slide link comprises a slot 120 made on an element bearing the second flank, notably made in the head 12*a* of the second member 12, and a pin 11 produced on the support, notably a pin built into the support. The slot and the pin are arranged and shaped so that they collaborate with one another to form the slide link. For preference, the slide link is arranged in such a way that its axis of translational or substantially translational movement is radial or substantially radial to the axis A1. In operation, the slot may pivot slightly about the pin. However, this pivoting remains entirely negligible which means that the connection is considered to be a slide link. If need be, the pin can be replaced by a non-circular, notably parallelepipedal, shape in order to limit this pivoting.

Thus, in this first alternative form, the head 12*a* of the elastic second member may constitute the calendar drive finger. The pin 11 may be replaced by a post 11 formed as an integral part of the member 1. When the calendar is in operation, the walls of the slot 120 are designed to come into abutment against the pin or the post.

The slot may be confined to a single-walled cutout.

Figure 11:
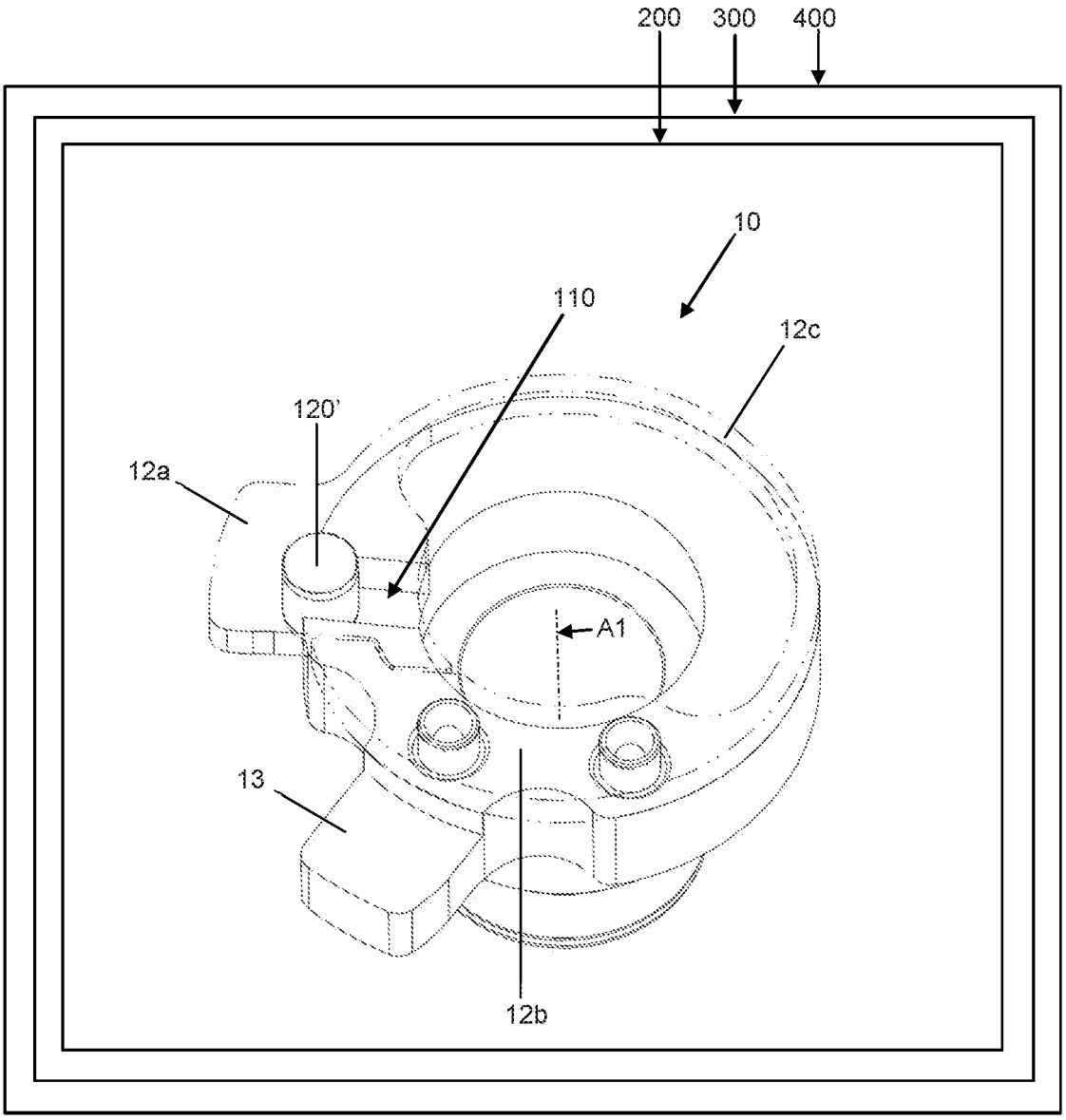
FIG. 11 is a schematic view of a second alternative form of a second embodiment of a timepiece.
Figure 12:
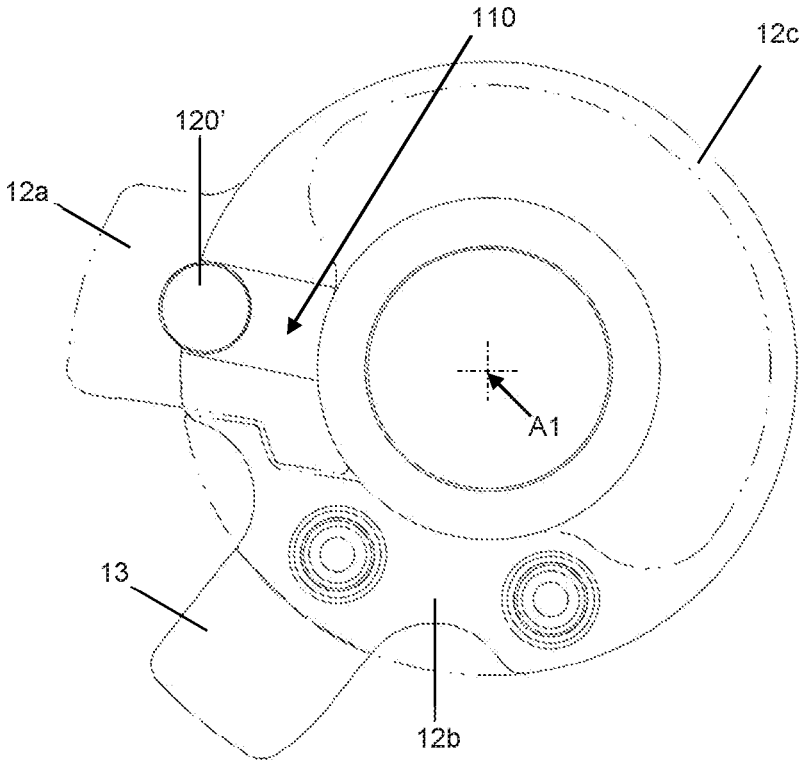
FIG. 12 is a detailed view of the second alternative form of the second embodiment.

In a second alternative form of the second embodiment depicted in FIGS. 11 and 12, the slide link comprises a pin 120' produced on an element bearing the second flank, notably a pin built into the head 12*a* of the second member 12, and a slot 110 produced on the support. The slot and the pin are arranged and shaped to collaborate with one another to produce the slide link. For preference, the slide link is arranged in such a way that its axis of translational or substantially translational movement is radial or substantially radial to the axis A1. In operation, the slot may pivot slightly about the pin. However, this pivoting remains entirely negligible which means that the connection is considered to be a slide link. If need be, the pin may be replaced by a non-circular, notably parallelepipedal, shape, in order to limit this pivoting.

In this second alternative form, the rigid first member 11 and the elastic second member 12 are arranged in two distinct planes or levels. This is because, in this alternative form, the drive finger and the slide link are produced on two planes perpendicular to the axis A1 and different. The principle of operation of the mobile 10 according to this second alternative form is similar to that of the first alternative form. In this alternative form, the elastic second member may exhibit a shape similar to that of the elastic second member of the first alternative form. The post 120' formed as an integral part of the head 12*a* or the pin 120' may extend in a plane P2 so as to move around within the cutout 110 made in the member 11. This cutout may preferably have the shape of a slot with two distinct walls, the purpose of this being to act as an end stop whatever the phase of operation of the calendar. Of course, this cutout could be limited to having just one wall.

Whatever the embodiment, the drive member 1 may moreover comprise an additional drive finger 13 intended to actuate an ancillary toothset, not depicted, at the end of a month comprising fewer than 31 days. For preference, this finger 13 is arranged at a level or on a plane distinct from that of the drive finger comprising the members 11 or 12*a*.

Embodiments of the drive device have been described hereinabove in applications to the driving of a calendar element. However, a drive device according to the invention may of course be used to drive any kind of element that allows the displaying or indicating of a piece of time information, notably information about hours and/or information regarding minutes. For preference, the display or indication of the time information is of the jumping type, particularly of the instantaneous jump type.

Unlike what is known from the prior art, in the solutions according to the invention, the elastic second member is notably distinguishable in that it is not intended to be tensioned gradually by the calendar disk in order to activate a more or less instantaneous date jump but in order to retract the drive mobile from the calendar toothset during a calendar adjustment phase. In the solutions according to the invention, the instantaneousness of the jump may for its part preferably be guaranteed by a cam 2 connected to, notably as one with, the support 11. Furthermore, the elastic second member is distinguishable in that at a first end it is built into the support and at a second end it is mounted in a slide link relative to this support. Finally, the drive finger, through its rigidity, allows the calendar disk to be driven in the most continuous possible way. This makes it possible to avoid any jerking of the calendar disk during the instantaneous jump.

Whatever the embodiment, the slide link is operational whatever the correction direction.

Whatever the embodiment, the second flank f12' is exclusively arranged in such a way as to receive an action to retract the drive mobile, i.e. the second flank and the element to be driven are arranged preferably so that the element to be driven acts exclusively and/or directly on the second flank. The first flank f11 is exclusively arranged in such a way as to receive an action to drive the element to be driven, i.e. the first flank and the element to be driven are arranged preferably so that the first flank acts exclusively and/or directly on the element to be driven to drive this element. Thus, the functions of the first flank and second flank are separate. In other words, the first flank is not used to retract the drive mobile and the second flank is not used to drive the element to be driven.

Whatever the embodiment, the first and second flanks are distinct.

In this whole document, "slide link" means "prismatic joint" or means preferably a mechanical joint or link allowing only one freedom degree, this freedom degree being translational according to the axis of the slide link.

In this whole document, "retracting the drive mobile" means preferably retracting an element or a part of the drive mobile, notably retracting a head 12*a* of the drive mobile.

The invention claimed is:

1. A drive device comprising a drive mobile for driving an element that is to be driven, notably a calendar element, the drive mobile being intended to be mounted so that it can rotate about an axis and comprising:

a support;

a first flank for driving the element that is to be driven; and a second flank arranged so as to receive an action to retract the drive mobile;

wherein the mobile comprises a slide link connecting the second flank to the support so that the second flank is movable relative to the first flank.

2. The device as claimed in claim 1, wherein the second flank is attached to the first flank.

3. The device as claimed in claim 2, wherein the mobile comprises an elastic return element returning the second flank toward a rest position.

4. The device as claimed in claim 1, wherein the mobile comprises an elastic return element returning the second flank toward a rest position.

5. The device as claimed in claim 4, wherein the elastic return element comprises a spring.

6. The device as claimed in claim 5, wherein the spring is in the form of an open ring and/or has the second flank at a first end and an attachment to the support at a second end.

7. The device as claimed in claim 1, wherein the slide link comprises a pin produced on an element bearing the second flank and a slot produced on the support or wherein the slide link comprises a slot produced on an element bearing the second flank and a pin produced on the support.

8. The device as claimed in claim 1, wherein the slide link comprises a first face produced on an element bearing the second flank and a second face produced on the support.

9. The device as claimed in claim 1, wherein the first flank exhibits a first surface that is planar or substantially planar or curved and/or wherein the second flank exhibits a second surface that is planar or substantially planar or curved.

10. The device as claimed in claim 1, wherein the first flank extends radially or substantially radially relative to the axis.

11. The device as claimed in claim 1, wherein the second flank is a retraction flank of the mobile.

12. The device as claimed in claim 1, wherein the support is secured to a calendar cam.

13. A horology calendar system comprising a drive device as claimed in claim 1 and an element that is to be driven which is a calendar indicator mobile.

14. A horology movement comprising a system as claimed in claim 13.

15. A timepiece comprising a movement as claimed in claim 14.

16. A horology calendar system according to claim 13, wherein the calendar indicator mobile is a disk indicating the days of the month.

17. The drive device according to claim 1, wherein the second flank extends orthoradially or substantially orthoradially with respect to the axis.

18. A drive device comprising a drive mobile for driving an element that is to be driven, notably a calendar element, the drive mobile being intended to be mounted so that it can rotate about an axis and comprising:

a support;

a first flank for driving the element that is to be driven; and a second flank arranged so as to receive an action to retract the drive mobile;

wherein the mobile comprises a slide link connecting the second flank to the support, and wherein the mobile comprises a third flank for braking the element that is to be driven.

19. The device as claimed in claim 18, wherein the first flank is fixed or substantially fixed angularly about the axis with respect to the support and/or wherein the third flank is fixed or substantially fixed angularly about the axis with respect to the support.

20. The device as claimed in claim 18, wherein the third flank extends radially or substantially radially relative to the axis.

* * * * *